US006662949B2

(12) United States Patent
Zheng et al.

(10) Patent No.: US 6,662,949 B2
(45) Date of Patent: Dec. 16, 2003

(54) PACKAGE FOR MECHANICAL OR ELECTRICAL COMPONENTS

(75) Inventors: Qisheng Zheng, Kunsan (CN); Qing Wan, Kunsan (CN); Xin Lai Song, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 34 days.

(21) Appl. No.: 10/040,348

(22) Filed: Dec. 28, 2001

(65) Prior Publication Data

US 2003/0121819 A1 Jul. 3, 2003

(51) Int. Cl.[7] ..... B65D 21/00

(52) U.S. Cl. ..... 206/499; 206/508; 206/725

(58) Field of Search ..... 206/701, 722, 206/725, 561, 562, 564, 565, 566, 505, 507, 508, 509, 511, 499, 514

(56) References Cited

U.S. PATENT DOCUMENTS 3,732,976 A * 5/1973 Bessett et al. ..... 206/499
3,771,646 A * 11/1973 Mascetti, Jr. ..... 206/327
3,896,239 A * 7/1975 Peters ..... 426/119
4,101,049 A * 7/1978 Wallace et al. ..... 206/521.1
4,195,743 A * 4/1980 Emery ..... 217/26.5
D361,508 S * 8/1995 Schnack ..... D9/341
D380,961 S * 7/1997 Schnack ..... D9/347
5,856,176 A * 1/1999 Mathus et al. ..... 435/288.3
5,934,471 A * 8/1999 Jun ..... 206/509
5,957,293 A * 9/1999 Pakeriasamy ..... 206/725
6,116,427 A * 9/2000 Wu et al. ..... 206/706
6,296,122 B1 * 10/2001 Nakazono et al. ..... 206/707
6,357,595 B2 * 3/2002 Sembonmatsu et al. .... 206/726

* cited by examiner

*Primary Examiner*—Shian Luong
(74) *Attorney, Agent, or Firm*—Wei Te Chung

(57) ABSTRACT

A package (10) for packaging mechanical or electrical components (12) comprises a plurality of bases (14) and covers (16). Each base defines plural rows of component retaining slots (18*a*) to retain components therein, and securing edges (20*a*) around an outside thereof. Each cover defines a plurality of component retaining slots (24*a*) to retain components therein, and securing edges (25*a*) around an outside thereof. The bases and the covers are alternately stacked and an upper one of adjacent base and cover engages a lower one of the adjacent base and cover.

7 Claims, 7 Drawing Sheets

PACKAGE FOR MECHANICAL OR ELECTRICAL COMPONENTS

BACKGROUND OF THE INVENTION

1. Field of Invention

The present invention relates to a package, and particularly to a package for packaging mechanical or electrical components.

2. Description of Related Art

Referring to FIG. 3, a conventional package 40 for packaging a plurality of mechanical components 42 (only one being shown) includes a base 44 and a cover 46 to be secured together. The base 44 includes a top wall 48 defining a plurality of spaced component retaining slots 48*a* for retaining the components 42 therein, and four side walls 50 integrally formed with the top wall 48 and having securing edges 50*a* at bottoms thereof. The cover 46 includes a top wall 52 defining a plurality of depressed walls 52*a* therein to press the components 42 against the base 44, and four side walls 54 integrally formed with the top wall 52 and having securing edges 54*a* to engage to a top edge of the base 44. Each component 42 includes an insulating portion 56 to be placed into the component retaining slots 48*a* of the base 44, and a metal shell 58 assembled with the insulating portion 56.

However, the conventional package 40 has two obvious shortcomings. The first is that the cover 46 of the package 40 is only provided for assisting the base 44 to package the components 42 but not for receiving components 42. On the other hand, the component retaining slots 48*a* of the base 44 are separated from one another so that base 44 is not able to retain more components 42 therein.

SUMMARY OF THE INVENTION

Accordingly, a first object of the present invention is to provide a package having a relatively low stacked profile to decrease the occupying space.

A second object of the present invention is to provide a package capable of packaging more mechanical or electrical components.

To fulfill the above-mentioned object, a package for packaging mechanical or electrical components comprises a plurality of bases and covers alternatively stacked with each other. Each base defines plural rows of component retaining slots to retain components therein, and securing edges around an outside thereof. Each cover defines a plurality of component retaining slots to retain components therein, and securing edges around an outside thereof. The component retaining slots of the bases and the covers are out of alignment so that an upper one of adjacent base and cover engage a lower one of the adjacent base and cover.

Other objects, advantages and novel features of the invention will become more apparent from the following detailed description of the preferred embodiment when taken in conjunction with the accompanying drawings.

DETAILED DESCRIPTION OF THE INVENTION

Figure 1:
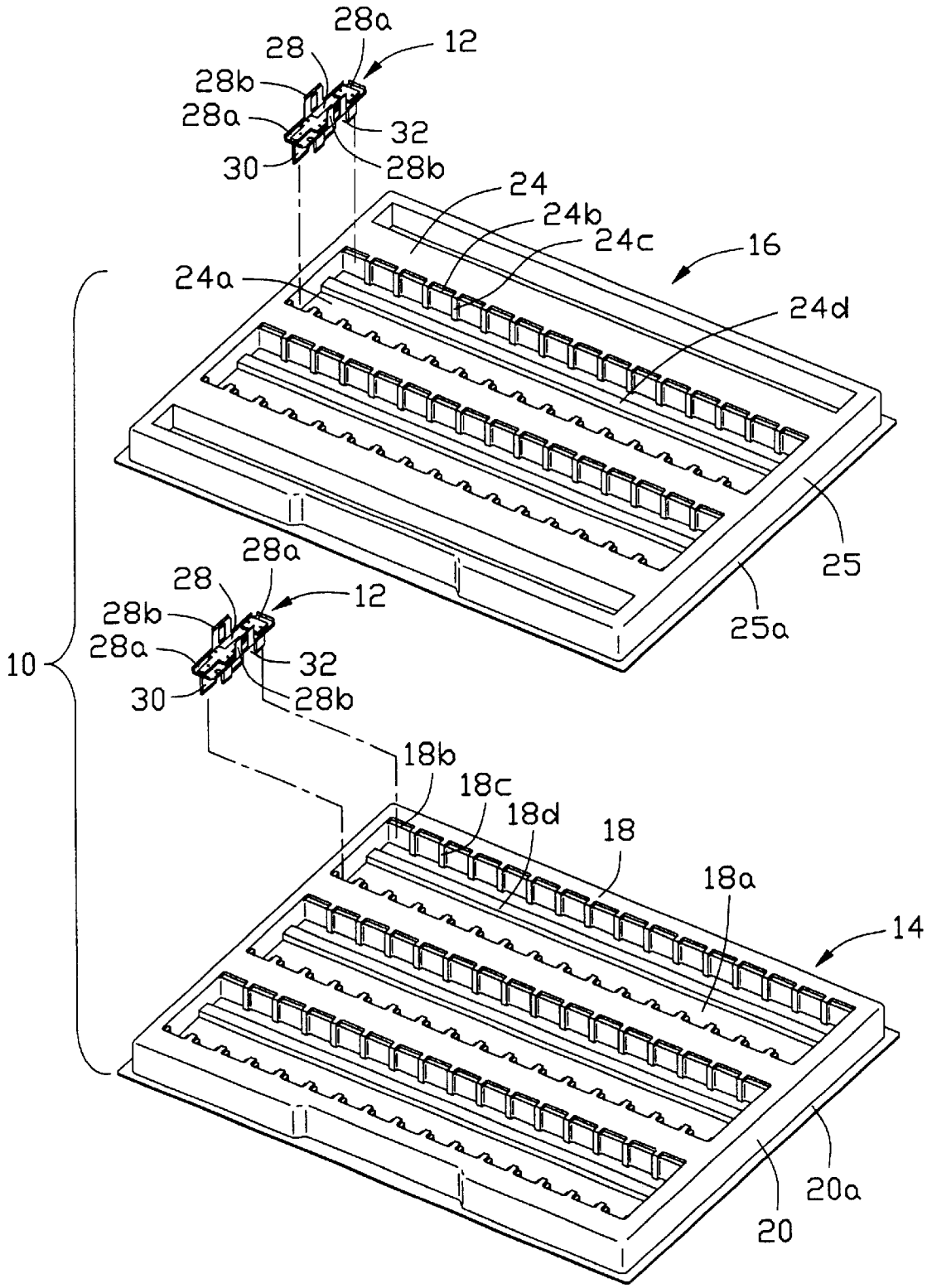
FIG. 1 is a perspective view of a base and a cover of a package of the present invention containing a mechanical component.

Reference will now be made to the drawing figures to describe the present invention in detail.

Referring to FIG. 1, a package 10 for packaging a plurality of mechanical or electrical components 12 includes a base 14 and a cover 16 to be placed one upon the other.

Figure 1A:
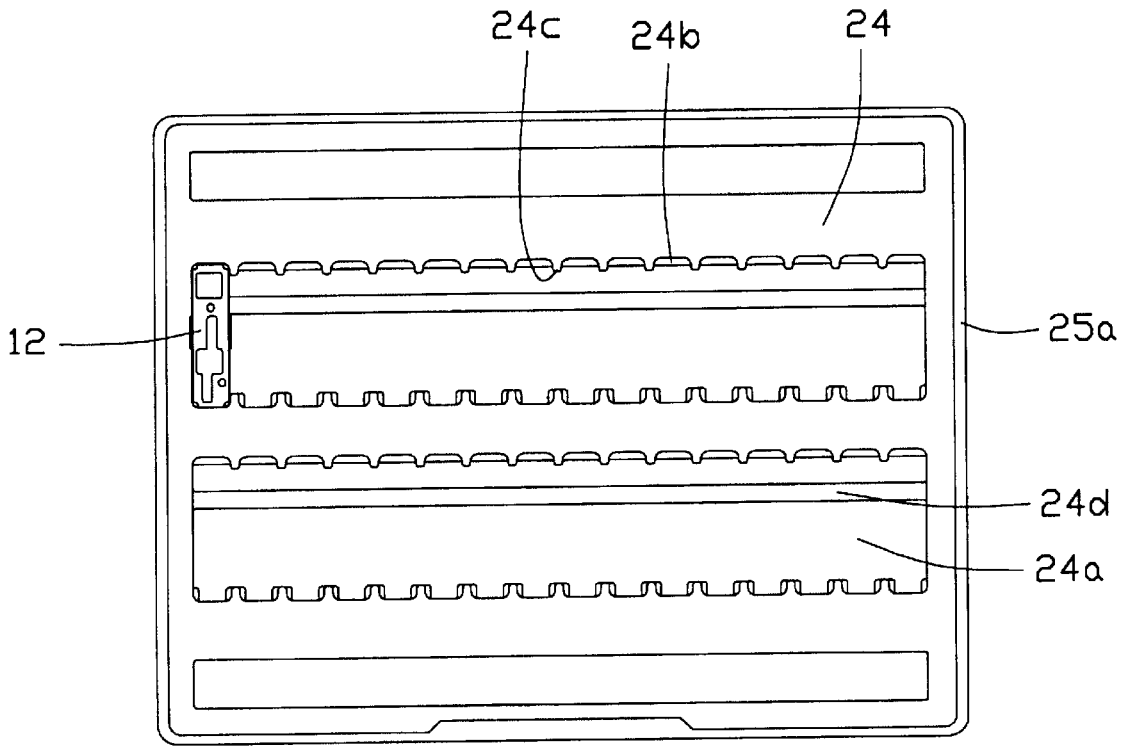
FIG. 1A is a top view of the cover of FIG. 1 wherein the mechanical component is retained in the cover.
Figure 1B:
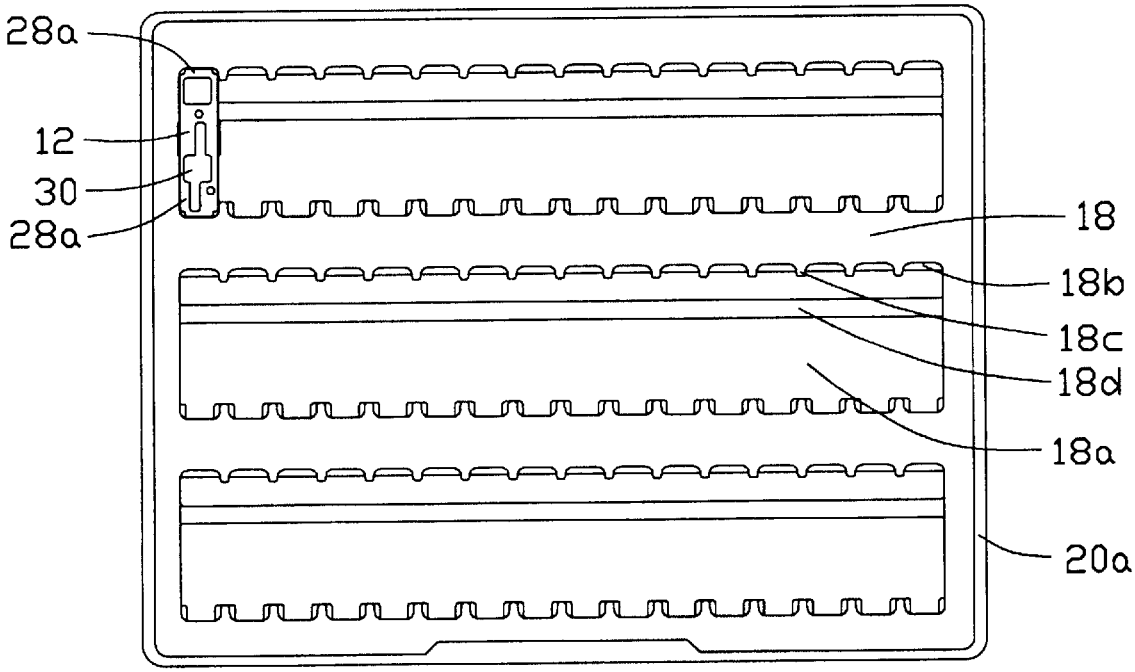
FIG. 1B is a top view of the base of FIG. 1 wherein the mechanical component is retained in the base.

Referring to FIGS. 1 and 1B, the base 14 includes a top wall 18 defining plural rows of component retaining slots 18*a* therein, and four side walls 20 integrally formed with the top wall 18 and having securing edges 20*a* at bottoms thereof. Each row of component retaining slots 18*a* define a plurality of retaining shoulders 18*b* stepped with the top wall 18 and spaced by a plurality of ribs 18*c* protruding into the retaining slots 18*a*. The base 14 further includes spacing bars 18*d* protruding from bottom walls of the retaining slots 18*a*. A tab receiving space 22 (FIG. 2A) is defined between each two adjacent component retaining slots 18*a* and opening at a bottom of the base 12.

Referring to FIGS. 1 and 1A, the cover 16 includes a top wall 24 defining a plurality of component retaining slots 24*a* therein, and four side walls 25 integrally formed with the top wall 24 and having securing edges 25*a* at bottoms thereof to engage to a top outside of the base 14. The cover 16 defines a plurality of retaining shoulders 24*b* in the component retaining slots 24*a* and stepped with the top wall 24 and spaced by a plurality of ribs 24*c*. The cover 16 further defines spacing bars 24*d* protruding from bottoms of the retaining slots 24*a*. A tab receiving space 26 (FIG. 2A) is defined between each two adjacent component retaining slots 24 and opening at a bottom of the cover 16.

Figure 1C:
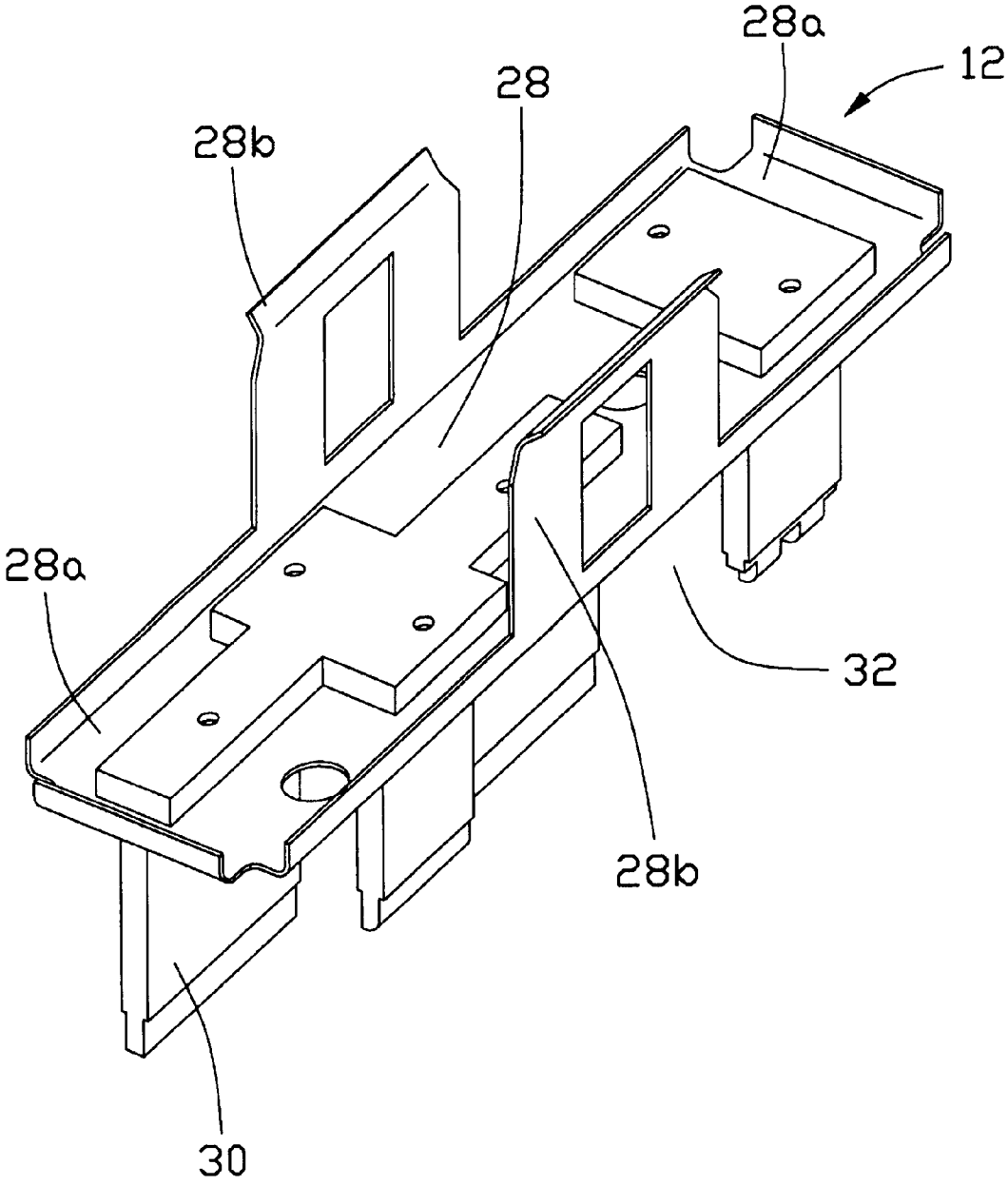
FIG. 1C is an enlarged view of the mechanical component of FIG. 1.

Referring to FIG. 1C, the mechanical component 12 includes a metal piece 28 and a plurality of insulating portions 30 insert molded with the metal piece 28. The metal piece 28 has a pair of retaining portions 28*a* at two elongate ends thereof and a pair of tabs 28*b* upwardly extending from two lateral sides thereof. The insulating portions 30 extend opposite to the tabs 28*b* and being divided into two groups by a recess 32.

Figure 2:
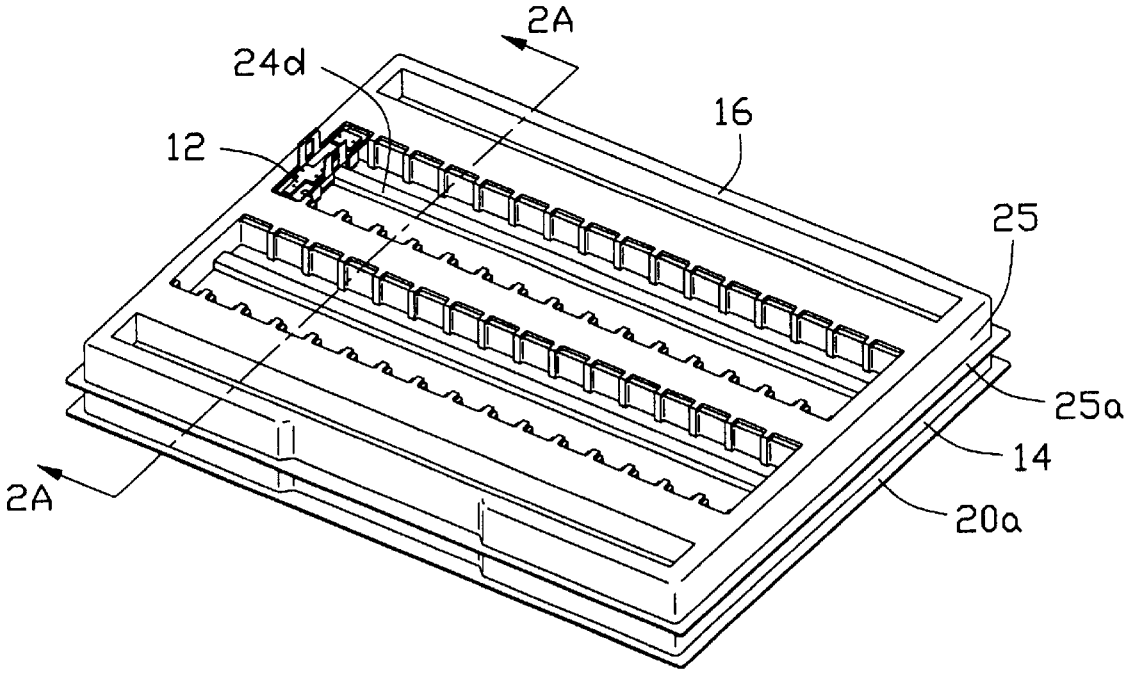
FIG. 2 is an assembled view of the package of FIG. 1.
Figure 2A:
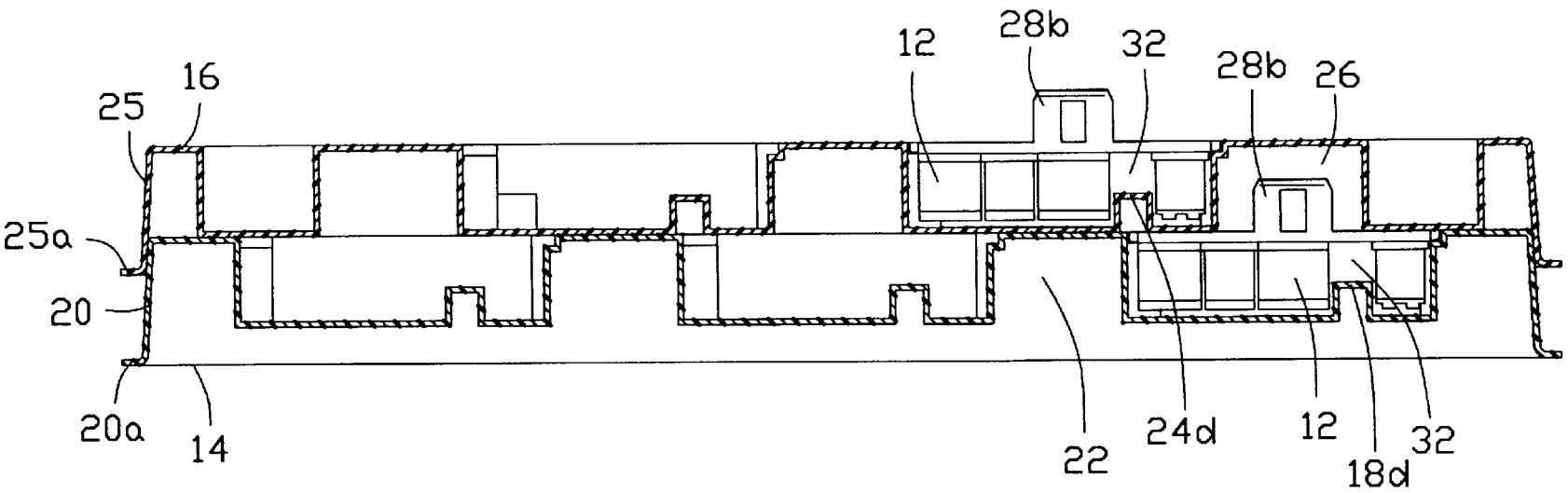
FIG. 2A is a cross-sectional view of FIG. 2 along line 2A—2A.
Figure 3:
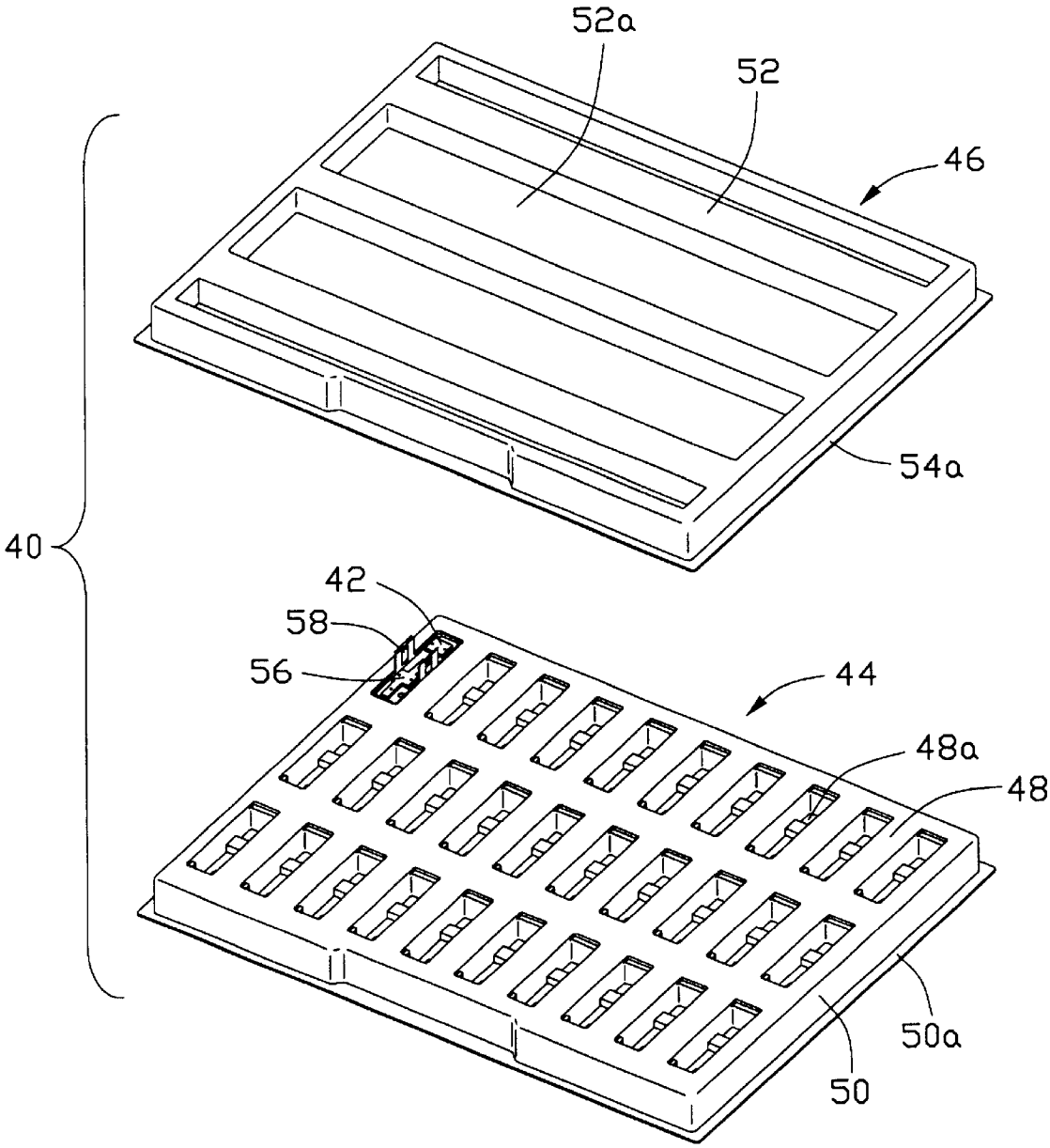
FIG. 3 (PRIOR ART)
FIG. 3 is an exploded view of a conventional package wherein a mechanical component is retained in a base of the package.

Referring to FIGS. 1, 2 and 2A, in assembly, the mechanical components 12 are arranged in the base 14 and the cover 16 of the package 1. The cover 16 is downwardly assembled to the base 14 by engaging the securing edges 25*a* of the cover 16 to an upper side of the base 14. The tabs 28*b* of the components 12 retained in the base 14 extend into the tab receiving space 26 of the cover 16. The spacing bars 18*d* and 24*d* of the base 14 and the cover 16 extend into the recesses 32 of the mechanical components 12 to prevent misorientation. The bottoms of the retaining slots 24*a* properly pressing against two opposite retaining portions 28*a* of the metal piece 28 of the mechanical components 12. Thus, the components 12 are securely retained in the base 14 and the cover 16.

It can be understand that the base and the cover of the present invention can be alternately stacked in succession wherein an upper one of adjacent base and cover engages a lower one of the adjacent base and cover. Accordingly, the cover 16 of the present invention not only assists the base 14 to secure the components 12 but also retains components 12 to enable the package 10 to retain more components 12 while having a relatively low profile after stacked. In addition, the present invention does not have spacing portions otherwise present between the component retaining slots according to prior art to retain more components 12 therein.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A package for packaging mechanical or electrical components, comprising:

a base including a top wall defining n rows of first component retaining slots and n−1 rows of first tab receiving spaces, and side walls connecting with the top wall and having securing edges at bottoms thereof, each first tab receiving space being defined between every two adjacent first component retaining slots from an opposite direction;

a cover placed upon the base and including a top wall defining n−1 rows of second component retaining slots and n rows second tab receiving spaces, and side walls connecting with the top wall and having securing edges at bottoms thereof to engage with the securing edges of the base to secure the base and the cover together, each second component retaining slot being defined between every two adjacent second tab receiving spaces from an opposite direction;

the first component retaining slots and the first tab receiving spaces of the base being respectively in alignment with the second tab receiving spaces and the second component retaining slots of the cover to receive 2n−1 rows of components therein.

2. The package as claimed in claim 1, wherein the base and the cover both define plural pairs of retaining shoulders in each row of component retaining slots, each pair of retaining shoulders supporting one of the components therein.

3. The package as claimed in claim 1, wherein the base and the cover both define a plurality of ribs in the component retaining slots to prevent the movement of the component in a direction along the component retaining slots.

4. The package as claimed in claim 1, wherein the base and the cover both define spacing bars protruding from the bottoms of the component retaining slots to prevent misorientation of the components.

5. The package as claimed in claim 1, wherein the package includes plural pairs of bases and covers alternately stacked with each other, securing edges of an upper one of adjacent base and cover engaging a lower one of the adjacent base and cover.

6. A package assembly comprising:

a plurality of components each defining a main body generally extending a full dimension along lengthwise direction thereof and an upper section extending upwardly from the main body with a dimension along said lengthwise direction;

a plurality of bases, each base defining n rows of upward component retaining slots and n−1 rows of downward component retaining slots between every two adjacent upward component retaining slots from an opposite direction;

a plurality of covers alternately stacked with the bases, each cover defining n−1 rows of upward component retaining slots corresponding to the downward component retaining slots of the base and n rows of downward component retaining slots corresponding to the upward component retaining slots of the base, each of said upward component retaining slots being dimensioned, along said lengthwise direction, slightly larger than said full dimensions, each downward component retaining slot being dimensioned, along said lengthwise direction, slightly larger than the dimension of the upper section of the component;

said components being contained between said bases and covers under a condition that for each component, the main body is received within one corresponding upward component retaining slot of a base while the upper section thereof is received within one corresponding downward component retaining slot of a cover directly seated on the base, thus reducing a total height of the package assembly.

7. A package assembly comprising:

a plurality of components (12) each defining a main body (30) extending a full lengthwise dimension along a lengthwise direction thereof with a downward recess (32), an upper section (28) extending upwardly from the main body (30), a lengthwise dimension of said upper section (28) along said lengthwise direction being smaller than said full lengthwise dimension;

a plurality of container parts (16) stacked upon one another, each of said container parts (16) defining a plurality of upward component retaining slots **(24*a*), each of said upward component retaining slots (24*a*)** defining a first width dimension along said lengthwise direction, said first width dimension being slightly larger than said full lengthwise dimension;

an upward spacing bar **(24*d*) continuously formed in each of said upward component retaining slots (24*a*)**;

each of said container parts (16) defining a plurality of downward component retaining slots (26) so as to cooperate with the upward component retaining slots **(24*a*) to form an alternative arrangement in each of the container pans along said lengthwise direction, each of the downward component retaining slots defining a second width dimension along said lengthwise direction, said second width dimension being slightly larger than the lengthwise dimension of the upper section (28); wherein the main body (30) of each of said components (12) is received in the corresponding upward component retaining slot (24*a*) of one of said containing parts (16) under a condition that the spacing bar (24*d*) in said upward component retaining slot (24*a*) is received in the downward recess (32) of the corresponding component (12) while the upper section (28) is received in the corresponding downward component retaining slot (26) of a neighboring container part (16) which is directly seated upon the corresponding containing part (16)**.

* * * * *